US005513967A

United States Patent [19]

Nakamoto et al.

[11] Patent Number: 5,513,967

[45] Date of Patent: May 7, 1996

[54] METHOD OF DETERMINING THE SHAPE OF SPIRAL ELEMENTS FOR SCROLL TYPE COMPRESSOR

[75] Inventors: Akira Nakamoto; Masakazu Obayashi; Kazuhiro Nomura; Hirouki Gennami, all of Kariya, Japan

[73] Assignee: Kabushiki Kaisha Toyoda Jidoshokki Seisakusho, Aichi, Japan

[21] Appl. No.: 403,737

[22] Filed: Mar. 15, 1995

[30] Foreign Application Priority Data

Jul. 16, 1993 [JP] Japan ..... 5-177049

[51] Int. Cl.[6] ..... F04C 18/04

[52] U.S. Cl. ..... 418/1; 418/55.2; 418/150

[58] Field of Search ..... 418/55.2, 150, 418/1

[56] References Cited

U.S. PATENT DOCUMENTS

| | | | |
|---|---|---|---|
| 4,678,415 | 7/1987 | Hirano et al. | 418/55.2 |
| 4,678,416 | 7/1987 | Hirano et al. | 418/150 |
| 4,781,549 | 11/1988 | Caillat | 418/55.2 |
| 4,856,973 | 8/1989 | Hirano et al. | 418/55.2 |

FOREIGN PATENT DOCUMENTS

| | | | |
|---|---|---|---|
| 0105684 | 4/1984 | European Pat. Off. . | |
| 6023284 | 2/1985 | Japan . | |
| 60-256581 | 12/1985 | Japan | 418/55.2 |
| 1257783 | 10/1989 | Japan . | |

*Primary Examiner*—John J. Vrablik

*Attorney, Agent, or Firm*—Burgess, Ryan and Wayne

[57] ABSTRACT

The surface of a central section of a spiral element formed on a stationary or a movable scroll unit of a scroll type compressor is determined through the steps of locating an outer wall surface changing point G in a first polar coordinate system X, Y having a first origin O, drawing a circle Cs with its center at the first origin O and with a diameter corresponding to the orbital radius e of the orbiting motion of the movable scroll unit, locating a contact point P at a desired contact angle β on the circle Cs, drawing a straight line m passing through the contact point P and the first origin O, drawing a straight line I passing the outer wall surface changing point G and inclined at a predetermined angle α to the X-axis, determining the intersection point C of the straight lines m and I, and determining a section of the contact curve in a second polar coordinate system having its second origin at the intersection point C by determining a smooth curve interconnecting the outer wall surface changing point G and the contact point P, and smoothly merging into an outer curve at the outer surface changing point G. The compression clearance formed between the scroll elements can be substantially reduced to zero at the final stage of a compression cycle so that the compression efficiency can be improved, the vibration and noise are reduced, and that the operation reliability can be improved.

10 Claims, 7 Drawing Sheets

METHOD OF DETERMINING THE SHAPE OF SPIRAL ELEMENTS FOR SCROLL TYPE COMPRESSOR

BACKGROUND ART

The present invention relates to a method of determining the shape of spiral elements for a scroll type compressor and, more particularly, to a method of determining the shape of spiral elements for stationary and movable scroll units of a scroll type compressor, capable of improving the curved shapes of portions of the outer surface and the inner surface of the spiral elements in the central region of the spiral to thereby improve the performance characteristics and operating reliability of the scroll type compressor.

TECHNICAL FIELD

Generally, a scroll type compressor has the construction shown in FIG. 8, illustrating a scroll type compressor in a sectional view, and in FIG. 9, schematically illustrating scroll units in an engaged state thereof. The scroll type compressor is provided with a housing 1, a stationary scroll unit 2 fixedly contained in the housing 1, a movable scroll unit 3 supported to be able to freely carry out an orbiting motion within the housing 1, a drive shaft 4 introducing a rotational input into the compressor from an external device.

The stationary scroll unit 2 has a stationary end plate 21, and a stationary spiral member 22 formed on one surface of the stationary end plate 21 integral with the stationary end plate 21.

The movable scroll unit 3 has a movable end plate 31, and a movable spiral member 32 formed on one surface of the movable end plate 31 integral with the movable end plate 31. The movable spiral member 32 is shifted through an angle π(radians) about a given center relative to the stationary spiral member 22, and movably engaged with the stationary spiral member 22.

When a rotational input is provided to the drive shaft 4 of the scroll type compressor, the movable scroll unit 3 is driven in an orbiting motion through an eccentric bush 7 and is restrained by a self-rotation preventing means 8. As the movable scroll unit 3 is driven for orbiting motion, the respective volumes of a plurality of compression chambers 5 formed between the stationary scroll unit 2 and the movable scroll unit 3 are sequentially moved and reduced from the outermost compression chamber 5 toward the innermost compression chamber 5 provided near the center of the stationary scroll unit to discharge a compressed fluid through a discharge port 61 formed in the stationary end plate 21 of the stationary scroll unit 2 into a discharge chamber 6.

In many scroll type compressors, each of the curved inner surfaces and the curved outer surfaces of the stationary spiral member 22 and the movable spiral member 32 extend along an involute curve, and when the curved outer and inner surfaces approach the central region of the spiral, the two surfaces extend along a given curve including two circular arcs.

The stationary spiral member 22 will be described in detail. For example, as shown in FIG. 10, a section of the outer surface 22a of the stationary spiral member 22 between the outer end, not shown, to a point G, which will be described later, extends along an involute curve I, and a section of the inner surface 22*b* of the stationary spiral member 22 between the outer end, not shown, to a point N extends along an involute curve I. These involute curves I along which the sections of the outer surface 22a and the inner surface 22*b* extend respectively are drawn, for example, outward from a base circle Cs having a diameter equal to an orbital radius e, i.e., the radius of a circular path for an orbiting motion and its center at the origin O of a polar coordinate system where the X-axis and the Y-axis of the polar coordinate system intersect each other.

Then, two center points $C_1$ and $C_2$, which are symmetrical with respect to the origin O, are determined, a circular arc L1 of a circle having a radius $r_g$ and its center at the center point $C_1$ is drawn from the point G to a point A, a circular arc $L_2$ of a circle having a radius $r_n(=r_g+e \ldots (1))$ and its center at the center point $C_2$ is drawn from the point N to a point B, and the points A and B respectively on the circular arcs $L_1$ and $L_2$ are connected by a line commonly tangential to both circular arcs.

When the positions of the center points $C_1$ and $C_2$ are properly and selectively determined and the respective radii $r_g$ and $r_n$ are varied so as to meet expression (1), the points A and B can become coincident with one another to thereby be automatically interconnected without using any common tangential line to the circular arcs. Thus, the point G on the outer surface 22a and the point N on the inner surface 22b are interconnected by a central curve including the two circular arcs $L_1$ and $L_2$ to complete the stationary spiral member 22. The movable spiral member 32 is completed in the same manner, except that the phase of the movable spiral member 32 is shifted by an angle π(radian) about the origin O.

The involute curves I merge into the circular arcs $L_1$ and $L_2$ at the points G and N respectively. The points G and N will be referred to as an outer surface changing point G and an inner surface changing point N hereinafter.

When it is required to improve the compression efficiency of a scroll type compressor, to reduce vibrations and noise of the compressor, and to improve the performance of the compressor, the respective central curves of the stationary spiral member 22 and the movable spiral member 32 must be in contact with or intersect the base circle Cs at a point P so that when a plurality of compression chambers 5 defined by the stationary spiral member 22 and the movable spiral member 32 in the outer section of the spiral merge into a single compression chamber in the central section, the compression chamber 5 completes discharging without any clearance, and so that a plurality of compression chambers 5 subsequently formed by the stationary and movable spiral members must again merge into a single chamber.

A conventional method of determining the shape of the stationary spiral member 22 and the movable spiral member 32 determines the shapes of the central curves by the circular arcs $L_1$ and $L_2$ of circles having radii $r_g$ and $r_n$ respectively. The radii $r_g$ and $r_n$ of the circular arcs $L_1$ and $L_2$ must be reduced when it is desired to increase the wall thickness of the central section of the spiral element to secure a sufficient physical strength for the improvement of the scroll type compressor.

However, if the radii $r_g$ and $r_n$ of the circular arcs $L_1$ and $L_2$ are reduced, the contact angle β (radian) between a straight line m extending from the origin O and passing the point P and the positive X-axis of the polar coordinate system increases and, consequently, a large spiral angle, i.e., the angular difference between the contact angle and the final involute angle of the involute curve, i.e., the center angle between the outer end and the inner end of the involute curve along which the entire length of the outer surface 22a continuously extends to the innermost point where the outer surface 22a joins to the inner surface 22b without changing at the outer surface changing point G into a surface extending along the central curve, cannot be secured and, when the outside diameter of the body of the scroll type compressor is fixed, the compression stroke, i.e., the distance of movement of the compression chamber 5 from the outer sections to the inner sections of the spiral members 22 and 32, is diminished and the torque varies widely. Consequently, the NVH (noise vibration harshness) is intensified.

DISCLOSURE OF THE INVENTION

Accordingly, an object of the present invention is to improve the performance of a scroll type compressor through an improvement of the curved shapes of the central portions of the outer and inner surfaces of the spiral elements of the stationary and movable scroll units, respectively, of the scroll type compressor so that the clearance between the spiral elements can be reduced to substantially zero at the final stage of compressing cycle of refrigerant in which the movable spiral element performs an orbiting motion relative to the stationary spiral element.

Another object of the present invention is to provide a method of determining the shape of the central portions of the outer and inner wall surfaces of the spiral elements of the stationary and movable scroll units of a scroll type compressor having a body of a given outside diameter in curved shapes that will reduce torque variation to the least extent, securing mechanical strength at the central portions of the respective spiral elements of the stationary scroll unit and the movable scroll unit.

In accordance with one aspect of the present invention, there is provided a method of determining the shape of spiral elements for the stationary and movable scroll units of a scroll type compressor in which each of the spiral elements has an outer wall surface and an inner wall surface, the shape of a section of the outer wall surface between the outermost end thereof and an outer wall surface changing point thereof being defined by a curved outer wall, the shape of a section of the inner wall surface between an outermost end thereof and an inner wall surface changing point thereon being defined by a curved inner wall, and the shape of a curved wall surface of a central section thereof extending between the outer wall surface changing point and the inner wall surface changing point being defined by a central curved wall surface, the method being characterized by comprising the steps of:

locating the outer wall surface changing point in a first polar coordinate system having a first origin and a first axis:

drawing a circle with its center at the first origin of the first polar coordinate system and with a diameter corresponding to an orbital radius of an orbiting motion of the movable scroll unit;

locating, on the circle, a contact point at which the central curved wall surface is in contact with the said circle, at a predetermined contact angle measured from the first axis of the first polar coordinate system;

drawing a first straight line passing the contact point and the first origin;

drawing a second straight line passing the outer wall surface changing point and inclined at a preselected angle to the first axis of the first polar coordinate system;

determining a section of the central curved wall in a second polar coordinate system having its origin at the intersection of the first and the second straight line, and a second axis by determining a smooth curved surface perpendicularly intersecting the second straight line at the outer wall surface changing point and perpendicularly intersecting the first straight line at the contact point on the said circle; and determining a curve of the spiral outer wall surface so as to intersect the second straight line perpendicularly at the outer wall surface changing point.

Preferably, a straight line passing the second origin and the outer wall surface changing point or the contact point on the circle is used as the second axis of the second polar coordinate system, and a part of the central curved wall is defined, when the coordinates of the outer wall surface changing point are $(r_1, \phi_1)$ and the coordinates of the contact point are $(r_2, \phi_2)$, by:

$$r(\phi)=a+b\cdot\phi+c\cdot\phi^2+d\cdot\phi^3$$

where a, b, c and d are constants, $r(\phi_1)=r_2$ and $dr(\phi)/d\phi=0$ when $\phi=\phi_1$, and $r(\phi_2)=r_2$ and $dr(\phi)/d\phi=0$ when $\phi=\phi_2$.

Furthermore, preferably, the contact point on the circle and the inner wall surface changing point are interconnected by a transferred central curve determined by determining a false curve translated in a direction away from the second origin by a distance corresponding to the orbital radius of the circular path of orbiting motion of the movable scroll unit from a part of the central curve and transferring the false curve symmetrically with respect to the first origin.

Preferably, the straight line passing the second origin, and the outer wall surface changing point or the contact point on the circle is used as the second axis of the second polar coordinate system, and a part of the central curve is defined, when $\phi$ (radian) is an angle measured from the second axis, the coordinates of the outer wall surface changing point are $(r_1, \phi_1)$ and the coordinates of the contact point are $(r_2, \phi_2)$, by the equations:

$$R(\phi)=r(\phi)+f(\phi)$$

$$r(\phi)=a+b\cdot\phi+c\cdot\phi^2+d\cdot\phi^3$$

$$f(\phi)=\alpha[1-\cos\{2\pi(\phi-\phi_1)/(\phi_2-\phi_1)\}]$$

where a, b, c and d are constants, $r(\phi_1)=r_1$, $dr(\phi)/d\phi=0$, $f(\phi)=0$ and $df(\phi)/d\phi=0$ when $\phi=\phi_1$, and $r(\phi_2)=r_2$, $dr(\phi)/d\phi=0$, $f(\phi_2)=0$ and $df(\phi)/d\phi=0$ when $\phi=\phi_2$.

In accordance with a second aspect of the present invention, there is provided a method of determining the shape of spiral elements for the stationary and the movable scroll unit of a scroll type compressor in which each of the spiral elements having an outer wall surface and an inner wall surface, a section of the outer wall surface between the outermost end thereof and an outer wall surface changing point thereon extending along an outer curve, a section of the inner wall surface between the outermost end thereof and an inner wall surface changing point thereon extending along an inner curve, and the surface of a central section of the spiral element between the outer wall surface changing point and the inner wall surface changing point extending along a central curve, the method comprising the steps of:

determining the inner wall surface changing point in a first polar coordinate system having a first origin and a first axis;

drawing a circle with its center at the first origin of the first polar coordinate system and with a diameter corresponding to the orbital radius of the circular path of the orbiting motion of the movable scroll unit;

determining a contact point having a given contact angle to the first axis of the first polar coordinate system and at which the central section touches the circle on the circle;

drawing a first straight line passing the contact point and the first origin;

drawing a second straight line from the inner wall surface changing point at a given angle to the first axis of the first polar coordinate system;

determining a part of the central curve in a second polar coordinate system having its origin at the intersection of the first and second straight lines and a second axis by drawing a smooth curve perpendicularly intersecting the second straight line at the inner wall surface changing point and perpendicularly intersecting the first straight line at the contact point on the circle: and determining the spiral inner curve so as to intersect the second straight line perpendicularly at the inner wall surface changing point.

In the method of determining the shape of the spiral elements of a scroll type compressor, in the second aspect of the present invention, preferably, the straight line passing the second origin, and the inner wall surface changing point or the contact point on the circle is used as the second axis of the second polar coordinate system, and a part of the central curve is defined, when $\phi$(radian) is an angle measured from the second axis, and when the coordinates of the inner wall surface changing point are $(r_1, \phi_1)$ and the coordinates of the contact point are $(r_2, \phi_2)$ , by the equation:

$$r(\phi)=a+b\cdot\phi+c\cdot\phi^2+d\cdot\phi^3$$

where a, b, c and d are constants, $r(\phi_1)=r_1$, $dr(\phi)/d\phi=0$ when $\phi=\phi_1$, and $r(\phi_2)=r_2$, and $dr(\phi)/d\phi=0$ when $\phi=\phi_2$.

Preferably, the contact point on the circle and the outer surface changing point are interconnected by a transferred central curve determined by determining a false curve approaching the second origin at a distance corresponding to the orbital radius of the circular path of the orbiting motion of the movable scroll unit from part of the central curve and shifting the false curve symmetrically with respect to the first origin.

Preferably, the method further has a step of adjusting the shape of the central curve defining the surface of the central section extending between the outer surface changing point and the inner surface changing point to adjust the thickness of the central section. A straight line passing the second origin, and the inner surface changing point or the contact point on the circle is used as the second axis of the second polar coordinate system, and part of the central curve is defined, when $\phi$ (radian) is an angle measured from the second axis, the coordinates of the inner surface changing point are $(r_1, \phi_1)$ and the coordinates of the contact point are $(r_2, \phi_2)$, by the equations:

$$R(\phi)=r(\phi)+f(\phi)$$

$$r(\phi)=a+b\cdot\phi+c\cdot\phi^2+d\cdot\phi^3$$

$$f(\phi)=\alpha[1-\cos\{2\pi(\phi-\phi_1)/(\phi_2-\phi_1)\}]$$

where a, b, c and d are constants, $r(\phi_1)=r_1$, $dr(\phi)/d\phi=0$, $f(\phi_1)=0$ and $df(\phi)/d\phi=0$ when $\phi=\phi_1$, and $r(\phi_2)=r_2$, $dr(\phi)/d\phi=0$, $f(\phi_2)=0$, and $df(\phi)/d\phi=0$ when $\phi=\phi_2$.

The shapes of the central sections of the spiral elements of the stationary scroll unit and the movable scroll unit determined by the method in accordance with the present invention come into contact or intersect each other at the contact point on the circle with a diameter corresponding to the orbital radius of the circular path of the orbiting motion of the movable scroll unit. Therefore, the clearance of one compression chamber defined by the central sections of the spiral elements of the stationary and the movable scroll unit is reduced virtually to zero at the final stage of a compression cycle of the scroll type compressor, the compressed refrigerant is discharged, and then a plurality of compression chambers (two compression chambers) defined by the outer sections of the spiral elements of the stationary and the movable scroll unit merge into a single compression chamber, so that the scroll type compressor is able to operate at a high compression efficiency.

When the shape of the central curve defining the central section extending between the outer surface changing point and the inner surface changing point is adjusted to adjust the thickness of the central section, the central section may be formed with a comparatively large wall thickness and the contact angle may be comparatively small.

BRIEF DESCRIPTION OF THE DRAWINGS

The above and other objects, features and advantages of the present invention will be made more apparent from the description with reference to the accompanying drawings, wherein.

BEST MODE OF CARRYING OUT THE INVENTION

A method of determining the shape of spiral elements for a scroll type compressor, embodying the present invention will be described hereinafter. The scroll type compressor provided with spiral elements shaped by the method of the present invention may be considered to be identical in construction with the conventional scroll type compressor, except that stationary and movable scroll units of the present invention are different from those of the conventional scroll type compressor, and hence the description of the construction and operation of the scroll type compressor will be omitted.

Figure 8:
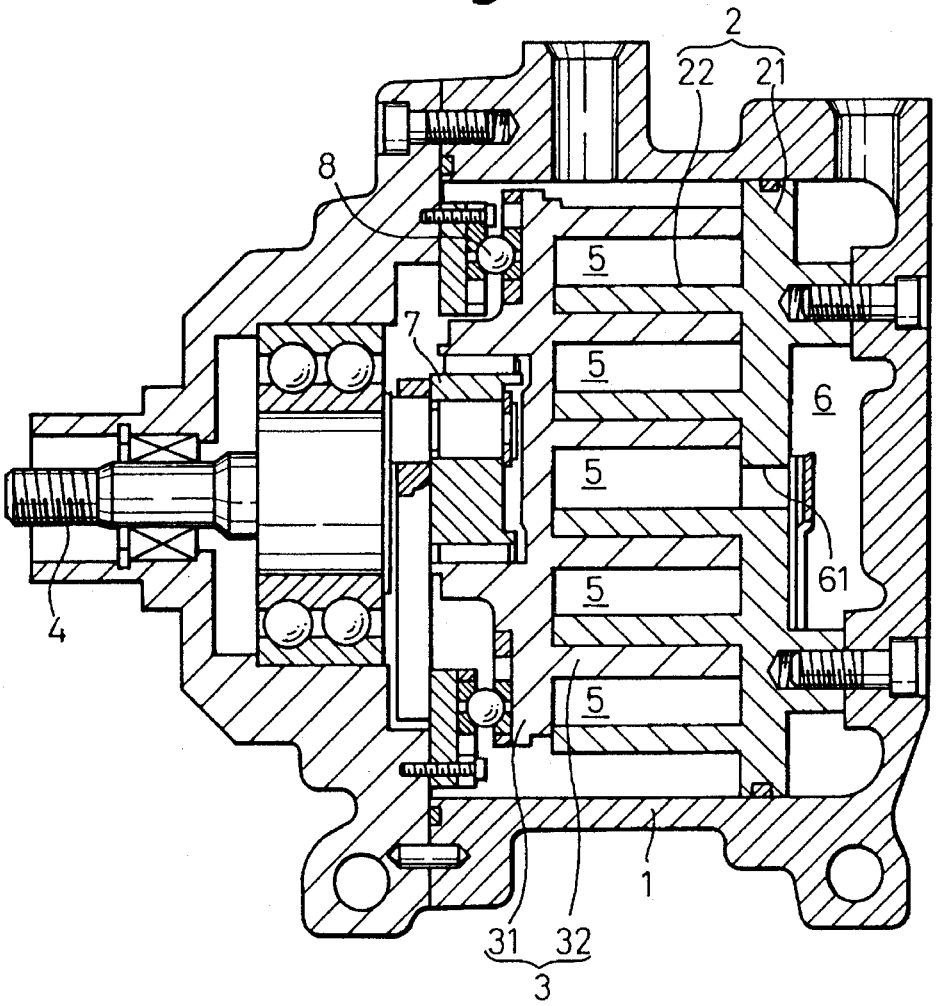
FIG. 8 is a longitudinal sectional view showing the general construction of a scroll type compressor to which a method of determining the shape of spiral elements in accordance with the present invention is to be applied.

FIGS. 1 through 4 illustrate phases of a method of determining the shape of spiral elements for the stationary and movable scroll units, which are the principal structural components in a scroll type compressor having a construction as shown in FIG. 8, as applied typically to determining of the shape of a stationary scroll unit by way of example.

Figure 1:
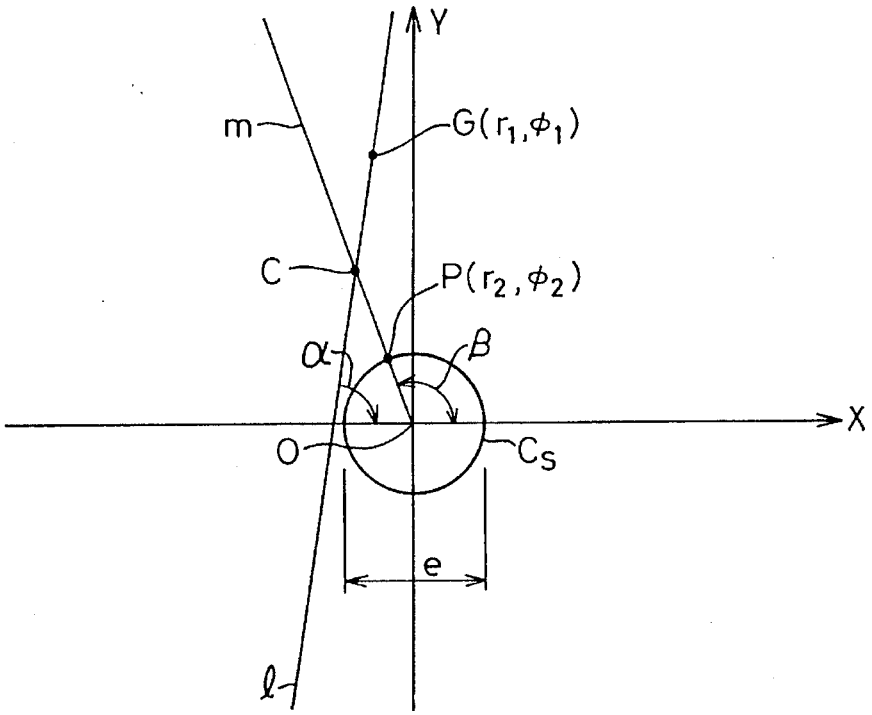
FIG. 1 is a graphical illustration of lines drawn in a polar coordinate system in the initial phase of a method of determining the shape of spiral elements for a scroll type compressor, according to a first embodiment of the present invention, as applied to determining the shape of a stationary spiral element of a stationary scroll unit by way of example.

The steps of determining the shape of a spiral element having an outer wall surface and an inner wall surface for a stationary scroll unit will be described with reference to FIG. 1. A first polar coordinate system (X-axis, Y-axis) having a first origin O is defined. An optional outer wall surface changing point G is determined in the first polar coordinate system and a circle Cs, with its center at the first origin O and with a diameter corresponding to an orbital radius e, is drawn. A changing point P at a given contact angle β(radian) measured from the positive X-axis is determined on the circle Cs and a straight line m passing the contact point P and the first origin O is drawn. A straight line 1 passing the outer surface changing point G and inclined at a given angle α(radian) to the X-axis is drawn. The straight line m and the straight line 1 intersect each other at an intersection point C.

Figure 2:
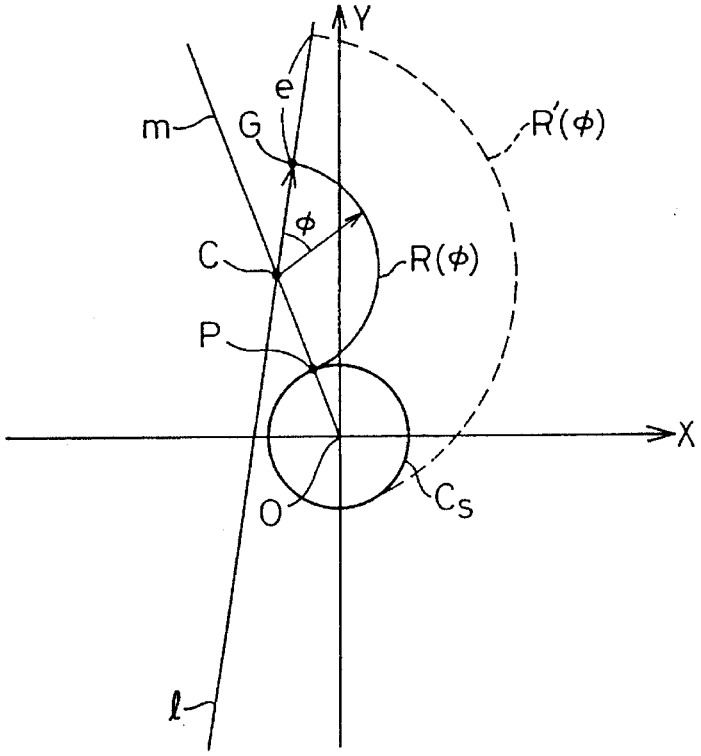
FIG. 2 is a graphical illustration of lines drawn in the polar coordinate system in an advanced phase of the method of determining the shape of spiral elements for a scroll type compressor according to the first embodiment.

Then, as shown in FIG. 2, a second polar coordinate system with a second origin located at the intersection point C and with the axis aligned with the straight line 1 is determined. A smooth central curve R(ϕ) curving about the intersection point C and interconnecting the outer wall surface changing point G and the contact point P is determined. The central curve R(ϕ) need not be limited to a circular curve, provided that the central curve R(ϕ) merges smoothly into an involute curve I (FIG. 4) defining the shape of the outer wall surface at the outer wall surface changing point G.

The central curve R(ϕ) is expressed in the second polar coordinate system having the second origin C and the axis CG, from which the angular coordinate of a point on the second polar coordinate system is measured, aligned with the straight line 1 by the equations:

$$R(\phi)=r(\phi)+f(\phi) \quad (1)$$

$$R(\phi)=r(\phi)+f(\phi) \quad (2)$$

$$r(\phi)=\alpha[1-\cos\{2\pi(\phi-\phi 1)/(\phi_2-\phi_1)\}] \quad (3)$$

where a, b, c and d are constants, α is a given angle, ϕ1(=0) is the angular coordinate of the outer wall surface changing point G, $\phi_2$ is the angular coordinate of the contact point P, $r_1$ is the distance between the second origin C and the outer wall surface changing point G, and $r_2$ is the distance between the second origin C and the contact point P.

when $\phi=\phi_1=0$, $r(\phi_1)=r_1$ $dr(\phi)/d\phi=0$ $f(\phi)=0$ $df(\phi)/d\phi=0$ when $\phi=\phi 2$ , $r(\phi_2)=r_2$ $dr(\phi)/d\phi=0$ $f(\phi)=0$ $df(\phi)/d\phi=0$ A false curve R'(ϕ) translated in a direction away from the second origin C by a distance corresponding to the orbital radius e from the central curve R(ϕ) is drawn.

Figure 3:
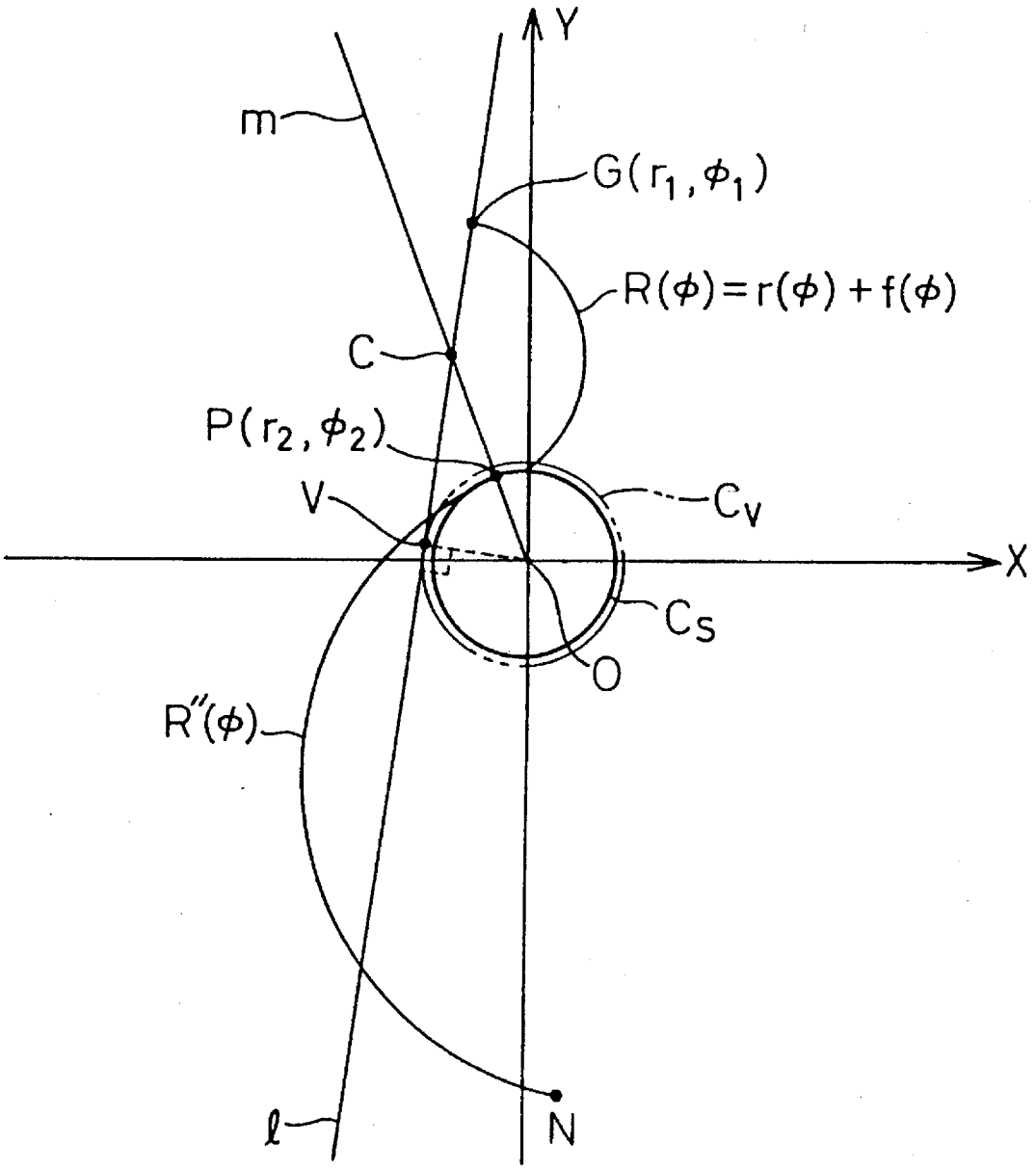
FIG. 3 is graphical illustration of a further advanced phase of the method of determining the shape of spiral elements for a scroll type compressor according to the first embodiment, on a polar coordinate system.

Then, as shown in FIG. 3, a transferred central curve R"(ϕ) symmetrical with the false curve R'(ϕ) with respect to the first origin O is drawn.

The contact point P and an inner wall surface changing point N are interconnected by the transferred central curve R".

Thus, the central curve R(ϕ) and the transferred central curve R"(ϕ) determines the shape of the surface of the central section of the stationary spiral element.

Then, an involute curve I expressed by the equation:

$$h=e'\cdot\theta$$

where h is the distance from a point on the circle Cs and θ is tile involute angle, is drawn outward from the outer wall surface changing point G in the first polar coordinate system.

It will readily be understood that the radius of the base circle Cv of the involute curve I is equal to the distance Ov between the first origin O and the foot v of the perpendicular from the first origin O to the straight line 1.

Figure 9:
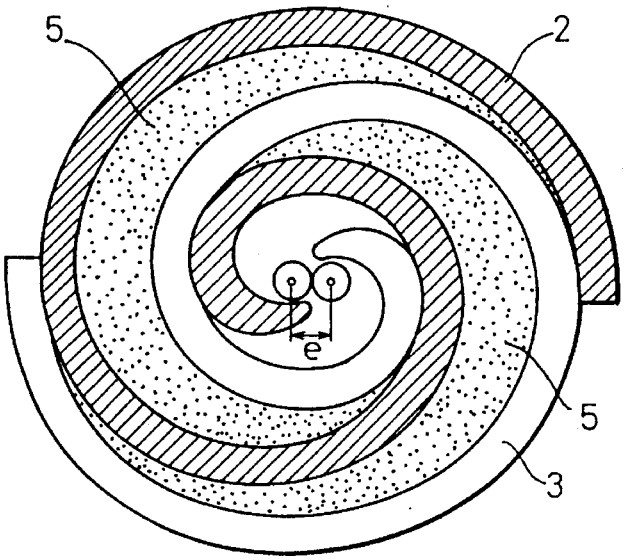
FIG. 9 is a schematic sectional view showing one phase of engagement of a stationary scroll unit and a movable scroll unit.
Figure 10:
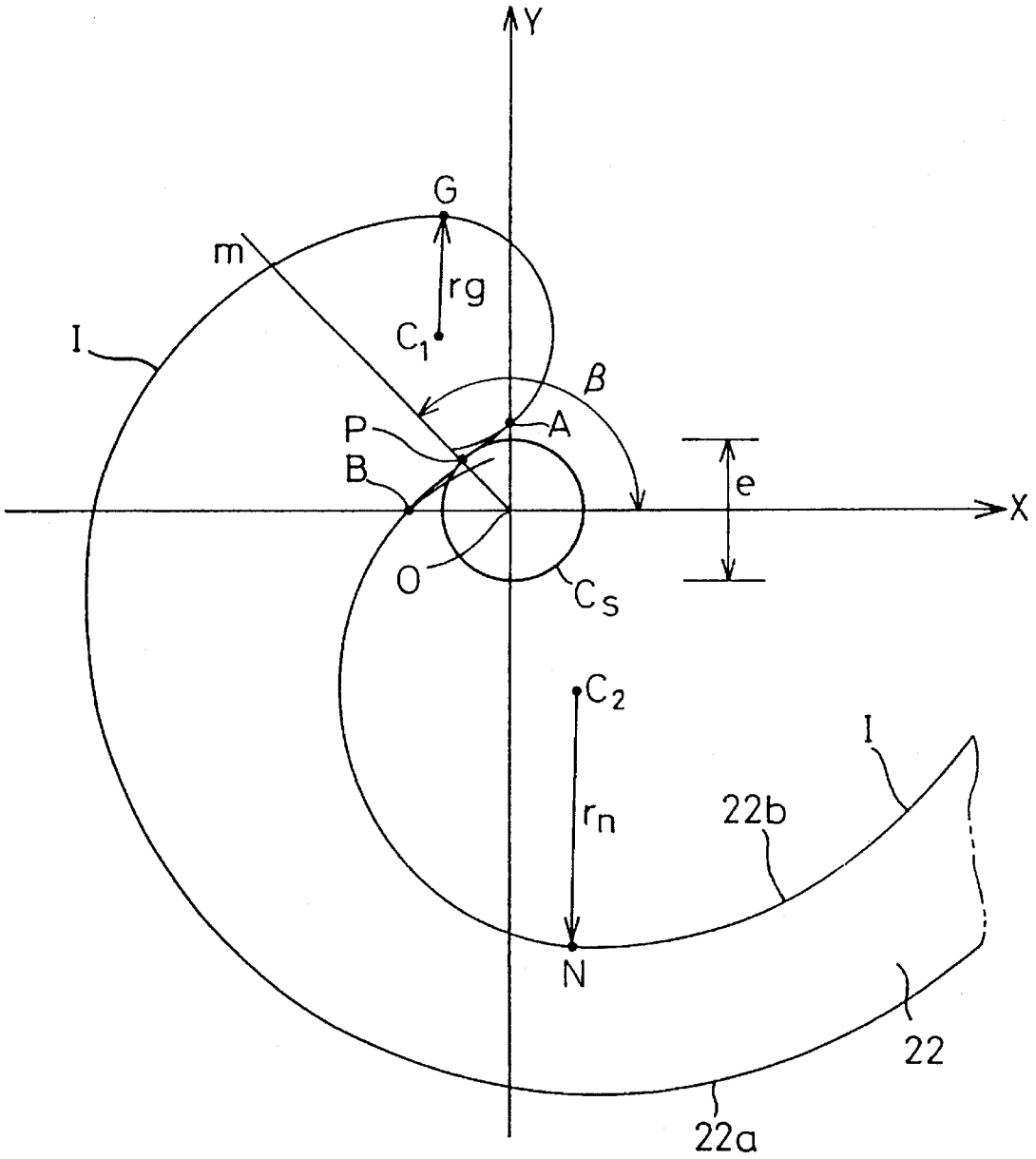
Fig.10 ( PRIOR ART )
FIG. 10 is a graphical illustration of the shape of a stationary spiral element for a stationary scroll unit determined by a conventional spiral element shaping method.

The involute angle θ of the outer wall surface changing point G determined by this embodiment is equal to that of the outer wall surface changing point G shown in FIG. 9 to enable the comparison of the conventional spiral element determining method shown in FIG. 9 and this embodiment.

The involute curve I connected to the outer wall surface changing point G is transferred so as to be connected to the inner wall surface changing point N to determine an involute curve I defining the inner wall surface. Thus, the shapes of the outer wall surface, the inner wall surface and the central surface of the stationary spiral element are determined. The involute angle θ of the inner surface changing point N determined by this embodiment is equal to that of the inner wall surface changing point N shown in FIG. 9 to enable the comparison of this embodiment and the conventional method of determining the shape of the spiral element.

Figure 4:
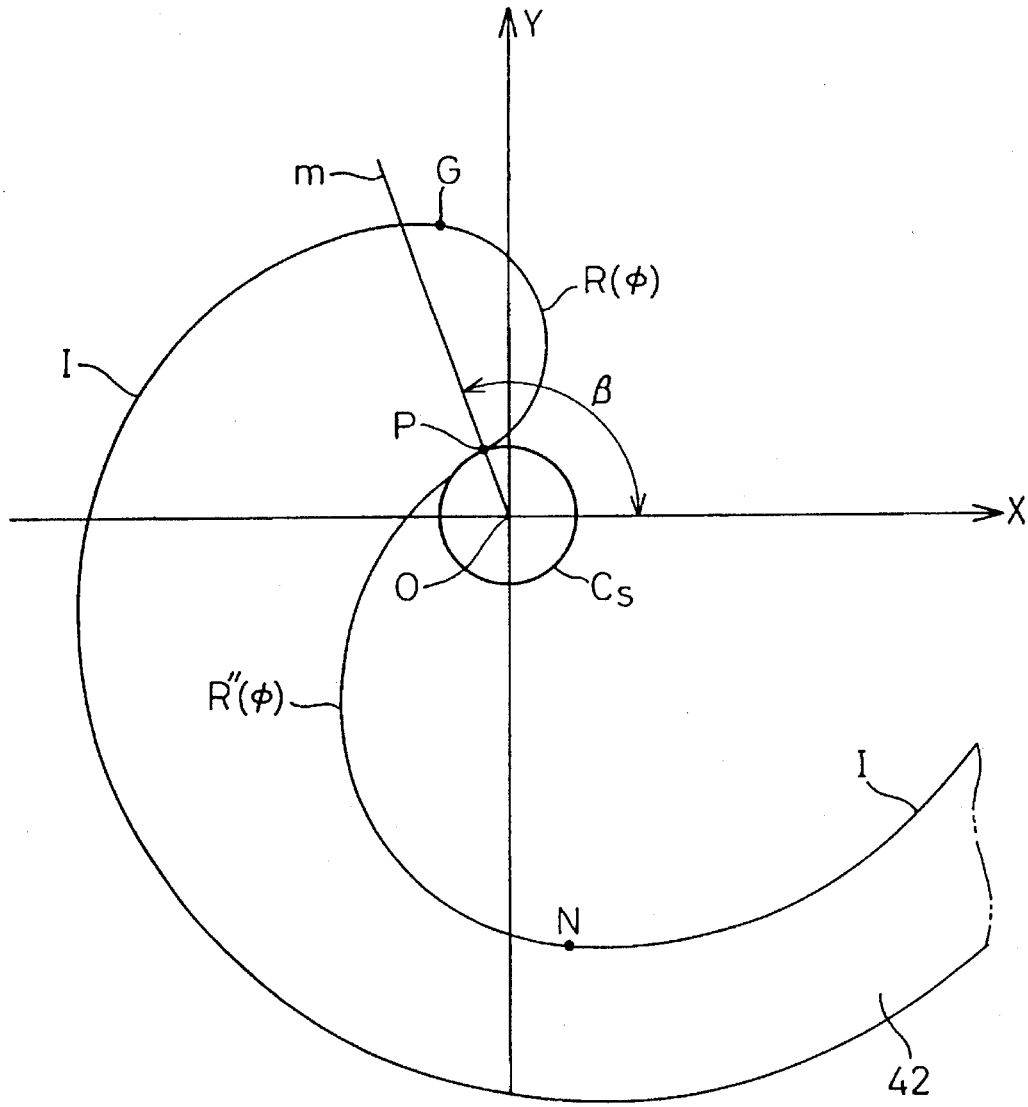
FIG. 4 is a graphical illustration of the respective shapes of the outer and inner surfaces of the stationary spiral element determined in the polar coordinate system by the method of determining the shape of spiral elements for a scroll type compressor according to the first embodiment.

FIG. 4 shows the central section of a stationary spiral element 42 having a shape defined by the involute curves I, the central curve R(ϕ) and the transferred central curve R"(ϕ). The outer wall surface and the inner wall surface of the stationary spiral element extend further outward, by a necessary length, for a desired compressing action.

Although the embodiment has been described as applied to determining the shape of the stationary spiral element, the movable spiral element can be shaped by exactly the same procedure.

In the scroll type compressor provided with the stationary and movable scroll units thus shaped, the central curve R(ϕ) defining the central wall surface, and the transfer central curve R"(ϕ) is necessarily in contact with or intersects the circle Cs at the contact point P. Therefore, the clearance of one compression chamber 5 formed in the central part is reduced to zero at the final stage of discharging operation, and a plurality of compression chambers 5 (normally, two compression chambers) (see FIG. 9) formed subsequently merge into a single compression chamber. , As is obvious from the afore-mentioned expression (1), the central curve R(ϕ) defined by the spiral element shaping method in the present embodiment includes a curve defined by f(ϕ); namely, the central section of the spiral element has a large wall thickness. As is obvious from the comparative observation of FIGS. 4 and 9, the angular coordinate of the contact point P on the circle Cs with a diameter corresponding to the orbital radius c determined by the spiral element determining method in the present embodiment is the given small contact angle β, and hence the spiral element secures a large central angle, i.e., the difference between the final involute angle and the contact angle β.

Accordingly, the spiral element determining method in the present embodiment is capable of determining the shape of the spiral elements so that the clearance of the compression chamber is substantially reduced to zero at the final stage of the compression cycle to discharge the compressed refrigerant, whereby the compression efficiency of the scroll type compressor is improved and vibrations and noise are reduced. The spiral element determining method is capable of readily securing the strength necessary for an improvement in the reliability of the central section of the spiral element. Since the central angle of the spiral elements shaped by the spiral element determining method according to the present embodiment is large as compared with that of the spiral elements of the conventional spiral type compressor having the same outside diameter, the length of the compression stroke in each compression cycle in which the compression chambers move sequentially from the outer sections toward the central sections of the spiral elements is increased and hence a change in a torque can be reduced.

A second embodiment of the present invention will be described hereinafter with reference to FIGS. 5 to 7.

In the following description of the second embodiment, it may be understood that the structural components excluding the stationary and movable scroll units of a scroll type compressor to which the second embodiment is applied are identical with those of the general scroll type compressor shown in FIG. 8, and hence the description of those structural components will be omitted.

First, a procedure for determining the outer surface and the inner surface of the stationary spiral element of the stationary scroll unit will be described.

Figure 5:
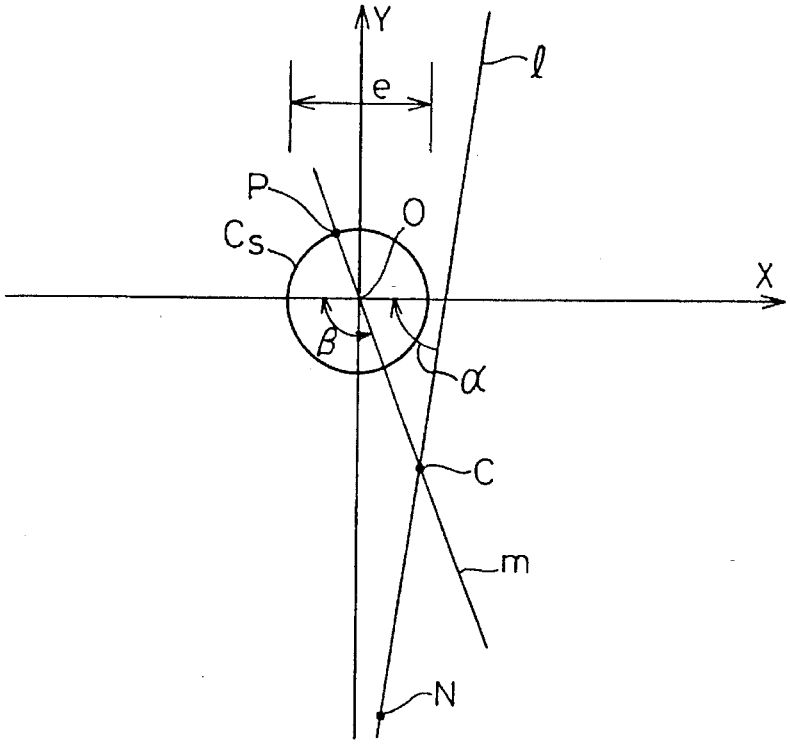
FIG. 5 is a graphical illustration, similar to FIG. 1, of lines drawn in a polar coordinate system in the early phase of a method of determining the shape of spiral elements for a scroll type compressor according to a second embodiment of the present invention.

Referring to FIG. 5, a first polar coordinate system (X-axis, Y-axis) having a first origin O is defined. An optional inner wall surface changing point N is set in the first polar coordinate system, and a circle Cs with its center at the first origin O and with a diameter corresponding to an orbital radius e is drawn. A contact point P at a given contact angle β (radian) is determined on the circle Cs, and a straight line m passing the contact point P and the first origin O is drawn. A straight line l passing the inner wall surface changing point N and inclined at an angle α(radian) to the X-axis is drawn. A point where the straight line 1 intersects the straight line m is defined as an intersection point C.

Figure 6:
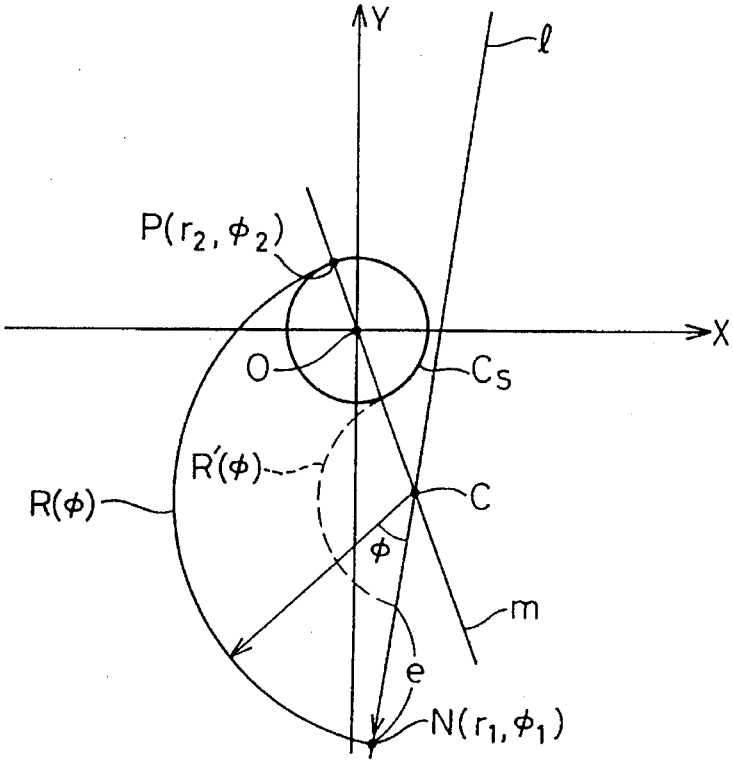
FIG. 6 is a graphical illustration, similar to FIG. 2, of lines drawn in the polar coordinate system in an advanced phase of the method of determining the shape of spiral elements for a scroll type compressor according to the second embodiment.
Figure 7:
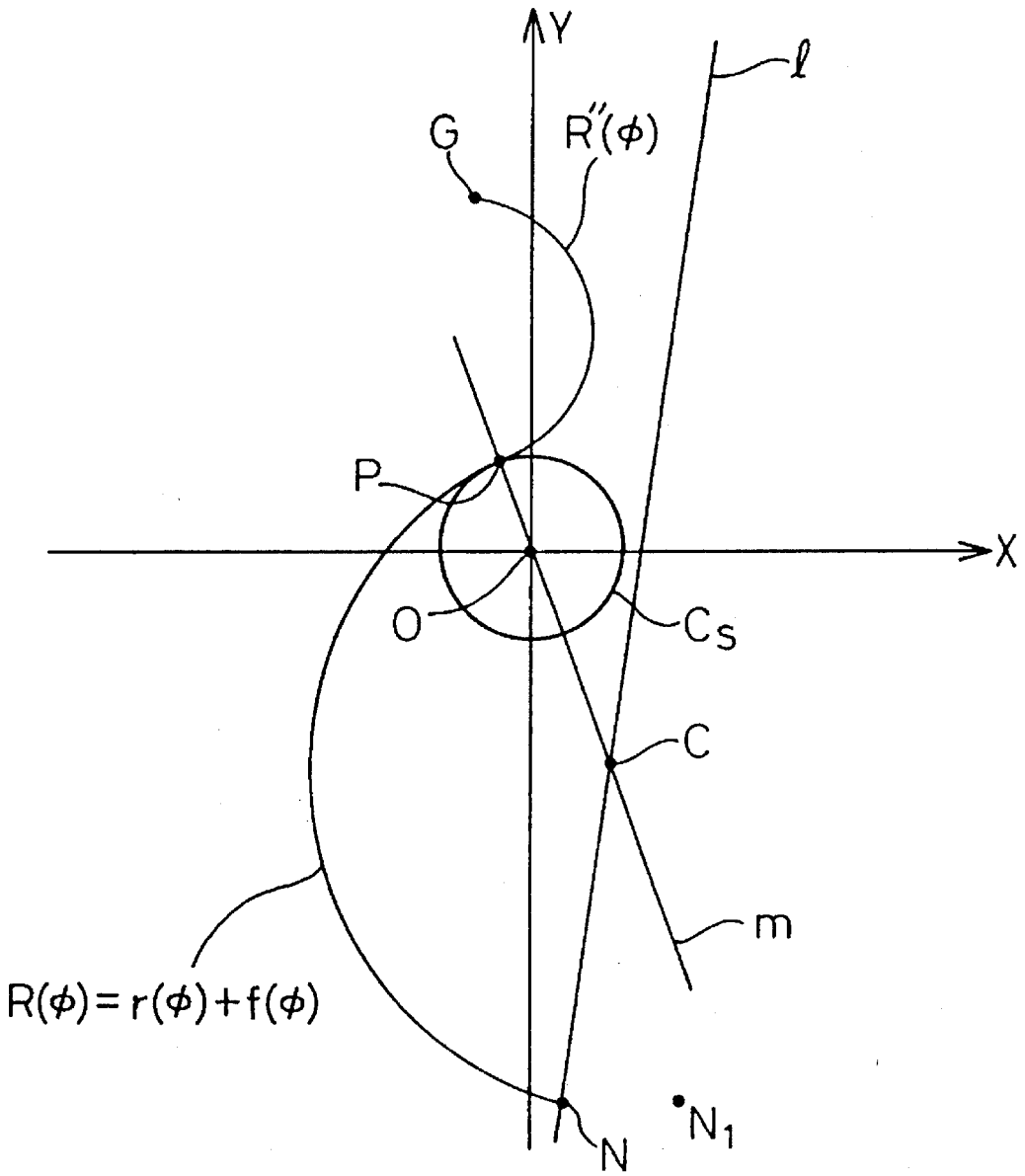
FIG. 7 is a graphical illustration of lines drawn in the polar coordinate system in a further advanced phase of the method of determining the shape of spiral elements for a scroll type compressor according to the second embodiment.

Subsequently, as shown in FIG. 6, a second polar coordinate system having a second origin at the intersection point C is defined, and the inner wall surface changing point N and the contact point P are interconnected with a smooth curve, which is a central curve R(ϕ) defining the shape of the surface of a central section. The central curve R(ϕ) must merge smoothly into an involute curve I (FIG. 4) defining the inner wall surface at the inner wall surface changing point N and touches the circle Cs smoothly at the contact point P.

The relation between the factors of the central curve R(ϕ)in the second polar coordinate system, i.e., angle ϕ(radian) measured from an axis aligned with the straight line CN passing the second origin C and the inner wall surface changing point N, constants a, b, c and d, the given angle α, the angular coordinate $\alpha_1$ of the inner wall surface changing point N, the angular coordinate $\phi_2$ of the contact point P, the distance $r_1$ between the second origin C and the inner surface changing point N, and the distance $r_2$ between the second origin C and the contact point P, is the same as that previously described in connection with the first embodiment. A false curve R'(ϕ) closer to the second origin C by a distance corresponding to the orbital radius e than the central curve R(ϕ) is determined Then, as shown in FIG. 7, the false curve R'(ϕ) is transferred symmetrically with respect to the first origin O to determine a transferred central curve R"(ϕ). The contact point P and the outer wall surface changing point G are interconnected by the transferred central curve R"(ϕ). Then, a procedure similar to that carried out by the first embodiment is carried out to shape a stationary spiral element 42 as shown in FIG. 4.

The spiral element determining method in the second embodiment has the same effect as that of the first embodiment.

Although the first and the second embodiments determine the false curve R'(ϕ) by shifting the central curve R(ϕ) and determine the transferred central curve R"(ϕ) by transferring the false curve R'(ϕ) to interconnect the wall surface changing point, and the outer wall surface changing point G or the inner wall surface changing point N as described above, it is also possible to shape stationary and movable spiral elements for the same stationary and the same movable scroll unit by a method that determines the central curve on the basis of a false second origin located at a distance corresponding to the orbital radius e from the second origin C.

Although the invention has been described in two embodiments, the subject of the present invention is a method of determining the shape of the curved wall surface of the central section of each of the spiral elements of the stationary and movable scroll units of a scroll type compressor and, therefore, the curves defining the shapes of the spiral outer wall surface and the spiral inner wall surface that are connected to the wall surface of the central section need not be limited to the involute curves and thus, the curves may be other suitable curves such as Archimedean spirals, parabolic curves, and hyperbolic curves.

As is understood from the foregoing description of the two embodiments, the present invention has the following advantageous effects.

(1) Since the central curve is in contact with, or intersects, a circle, with a diameter corresponding to the orbital radius, at a point on the circle, the clearance of the compression chamber is substantially reduced to zero at the final stage of the compression cycle, and as a result, the performance of the compressor is improved.

(2) The mechanical strength of the central sections of the spiral elements of the stationary and movable scroll units can be readily increased, so that the reliability of the compressor can be readily improved.

(3) Since a large center angle can be readily set, the length of the compression stroke when the stationary and movable scroll units provided with the spiral elements determined by the method of the present invention is longer than that when the scroll type compressor of the same outside diameter having a stationary and a movable scroll unit provided with spiral elements determined and shaped by the conventional method, so that variations in drive torque of the compressor can be easily reduced.

It should be understood by those skilled in the art that many changes and variations may be made to the embodiments of the present invention specifically described herein without departing from the spirit and scope of the present invention claimed in the accompanying claims.

We claim:

1. A method of determining the shape of spiral elements of the stationary and movable scroll units of a scroll type compressor in which each of said spiral elements has an outer wall surface and an inner wall surface, the shape of a section of said outer wall surface between the outermost end thereof and an outer wall surface changing point thereof being defined by a curved outer wall, the shape of a section of said inner wall surface between an outermost end thereof and an inner wall surface changing point thereon being defined by a curved inner wall, and the shape of a curved wall surface of a central section thereof extending between said outer wall surface changing point and said inner wall surface changing point being defined by a central curved wall surface, the method being characterized by comprising the steps of:

locating said outer wall surface changing point in a first polar coordinate system having a first origin and a first axis;

drawing a circle with its center at said first origin of said first polar coordinate system and with a diameter corresponding to an orbital radius of the orbiting motion of said movable scroll unit;

locating, on said circle, a contact point at which said central curved wall surface is in contact with said circle, at a predetermined contact angle measured from said first axis of said first polar coordinate system;

drawing a first straight line passing said contact point and said first origin;

drawing a second straight line passing said outer wall surface changing point and inclined at a preselected angle to said first axis of said first polar coordinate system, said second straight line intersecting said first straight line;

determining a section of said central curved wall, in a second polar coordinate system having a second axis and the origin at the intersection of said first and second straight lines, through determination of a smooth curved surface perpendicularly intersecting said second straight line at said outer wall surface changing point and perpendicularly intersecting said first straight line at said contact point on said circle; and determining a curve of said spiral outer wall surface so as to intersect said second straight line perpendicularly at said outer wall surface changing point.

2. A method of determining the shape of spiral elements of the stationary and movable scroll units of a scroll type compressor according to claim 1, wherein a straight line passing through said second origin, and through said outer surface changing point or said contact point on said circle is used as said second axis of said second polar coordinate system, an angle $\phi$(radian) is determined as an angle measured from said second axis, the coordinates of said outer surface changing point are $(r_1, \phi_2)$, and the coordinates of said contact point are $(r_2, \phi_2)$, part of said central curve is defined by the equation:

$$r(\phi)=a+b\cdot\phi+c\cdot\phi+d\cdot\phi^3$$

where a, b, c and d are constants, $r(\phi_1)=r_1$, and $dr(\phi)/d\phi=0$ when $\phi=\phi_1$, and $r(\phi_2)=r_2$, and $dr(\phi)/d\phi=0$ when $\phi=\phi_2$.

3. A method of determining the shape of spiral elements of the stationary and movable scroll units of a scroll type compressor according to claim 2, wherein said contact point on said circle and said inner surface changing point are interconnected by a transferred central curve determined by:

determining a false curve translated in a direction away from said second origin by a distance corresponding to said orbital radius of the orbital motion of said movable scroll unit from part of said central curve, and transferring said false curve symmetrically with respect to said first origin.

4. A method of determining the shape of spiral elements of the stationary and movable scroll units of a scroll type compressor according to claim 1, wherein the method further comprises the step of adjusting the shape of a central curve defining a wall surface of the central section extending between said outer wall surface changing point and said inner wall surface changing point to adjust a wall thickness of said central section.

5. A method of determining the shape of spiral elements of the stationary and movable scroll units of a scroll type compressor according to claim 4, wherein a straight line passing through said second origin, and through said inner wall surface changing point or said contact point is used as said second axis of said second polar coordinate system, an angle $\phi$(radian) is determined as an angle measured from the second axis, the coordinates of the outer surface changing point are $(r_1, \phi_1)$, and the coordinates of the contact point are $(r_2, \phi_2)$, part of said central curve is defined by the equations:

$$R(\phi)=r(\phi)+f(\phi)$$

$$r(\phi)=a+b\cdot\phi+c\cdot\phi^2+d\cdot\phi^3$$

$$f(\phi)=\alpha[1-\cos\{2\pi(\phi-\phi_1)/(\phi_2-\phi_1)\}]$$

where a, b, c and d are constants, $r(\phi_1)=r_1$, $dr(\phi)/d\phi=0$, $f(\phi_1)=0$, and $df(\phi)/d\phi=0$ when $\phi=\phi_1$, and $r(\phi_2)=r_2$, $dr(\phi)/d\phi=0$, $f(\phi_2)=0$, and $df(\phi)/d\phi=0$ when $\phi=\phi_2$.

6. A method of determining the shape of spiral elements of the stationary and movable scroll units for a scroll type compressor in which each of the spiral elements has an outer wall surface and an inner wall surface, a section of the outer wall surface between the outermost end thereof and an outer wall surface changing point thereon extends along an outer curve, a section of the inner wall surface between the outermost end thereof and an inner wall surface changing point thereon extends along an inner curve, and the surface of a central section of the spiral element between said outer wall surface changing point and said inner wall surface changing point extends along a central curve, the method being characterized by comprising the steps of:

determining said inner wall surface changing point in a first polar coordinate system having a first origin and a first axis;

drawing a given circle with its center at said first origin of said first polar coordinate system and with a diameter corresponding to an orbital radius of an orbiting motion of said movable scroll unit;

determining, on said circle, a contact point where said circle has a given contact angle to said first axis of said first polar coordinate system and at which said central section touches said given circle;

drawing a first straight line passing said contact point and said first origin;

drawing a second straight line from said inner wall surface changing point at a given angle to said first axis of said first polar coordinate system, said second straight line intersecting said first straight line;

determining a part of said central curve in a second polar coordinate system having its origin at said intersection of said first and second straight lines and a second axis by drawing a smooth curve perpendicularly intersecting said second straight line at said inner wall surface changing point and perpendicularly intersecting said first straight line at said contact point on said given circle; and determining a spiral inner wall curve so as to perpendicularly intersect said second straight line at said inner wall surface changing point.

7. A method of determining the shape of spiral elements of the stationary and movable scroll units of a scroll type compressor according to claim 6, wherein a straight line passing through said second origin and through said inner wall surface changing point or said contact line on said given circle is used as the second axis of said second polar coordinate system, an angle $\phi$(radian) is determined as an angle measured from said second axis, the coordinates of the inner wall surface changing point are $(r_1, \phi_1)$ and the coordinates of said contact point are $(r_2, \phi_2)$, part of said central curve is defined by the equation:

$$r(\phi)=a+b\cdot\phi+c\cdot\phi^2+d\cdot\phi^3$$

where a, b, c and d are constants, $r(\phi_1)=r_1$, and $dr(\phi)/\phi d=0$ when $\phi=\phi_1$, and $r(\phi_2)=r_2$, and $dr(\phi)/d\phi=0$ when $\phi=\phi_2$.

8. A method of determining the shape of spiral elements of the stationary and movable scroll units of a scroll type compressor according to claim 7, wherein the contact point on said given circle and said outer wall surface changing point are interconnected by a transferred central curve determined by:

determining a false curve translated in a direction toward said second origin by a distance corresponding to the orbital radius of orbital motion of said movable scroll unit from part of said central curve, and transferring said false curve symmetrically with respect to said first origin.

9. A method of determining the shape of spiral elements of the stationary and movable scroll units of a scroll type compressor according to claim 6, wherein the method further comprises a step of adjusting the shape of the central curve defining the surface of said central section extending between said outer wall surface changing point and said inner wall surface changing point to adjust a wall thickness of said central section.

10. A method of determining the shape of spiral elements of the stationary and movable scroll units of a scroll type compressor according to claim 9, wherein a straight line passing through said second origin, and through said inner wall surface changing point or said contact point on said given circle is used as the second axis of said second polar coordinate system, an angle $\phi$(radian) is determined as an angle measured from the second axis, the coordinates of the inner surface changing point are $(r_1, \phi_1)$, and the coordinates of the contact point are $(r_2, \phi_2)$, part of the central curve is defined by the equations:

$$R(\phi)=r(\phi)+f(\phi)$$

$$r(\phi)=a+b\cdot\phi+c\cdot\phi^2+d\cdot\phi^3$$

$$f(\phi)=\alpha[1-\cos\{2\pi(\phi-\phi_1)/(\phi_2-\phi_1)\}]$$

where a, b, c and d are constants, $r(\phi_1)=r_1$, $dr(\phi)/d\phi=0$, $f(\phi_1)=0$, and $df(\phi)/d\phi=0$ when $\phi=\phi_1$, and $r(\phi_2)=r_2$, $dr(\phi)/d\phi=0$, $f(\phi_2)=0$, and $df(\phi)/d\phi=0$ when $\phi=\phi_2$.

* * * * *